US011299866B2

(12) United States Patent
Mahrenholz

(10) Patent No.: US 11,299,866 B2
(45) Date of Patent: Apr. 12, 2022

(54) DOZER BLADE ATTACHMENT CONTROL SYSTEM AND APPARATUS FOR A COMPACT TRACK LOADER

(71) Applicant: DEERE & COMPANY, Moline, IL (US)

(72) Inventor: John Mahrenholz, Dubuque, IA (US)

(73) Assignee: Deere & Company, Moline, IL (US)

( * ) Notice: Subject to any disclaimer, the term of this patent is extended or adjusted under 35 U.S.C. 154(b) by 393 days.

(21) Appl. No.: 16/581,582

(22) Filed: Sep. 24, 2019

(65) Prior Publication Data

US 2021/0087782 A1 Mar. 25, 2021

(51) Int. Cl.

| | |
|---|---|
| ***E02F 3/84*** | (2006.01) |
| ***E02F 3/76*** | (2006.01) |
| ***F15B 1/02*** | (2006.01) |
| ***E02F 9/22*** | (2006.01) |

(52) U.S. Cl.

CPC ..... *E02F 3/844* (2013.01); *E02F 3/7613* (2013.01); *E02F 3/7618* (2013.01); *E02F 9/2228* (2013.01); *E02F 9/2282* (2013.01); *E02F 9/2285* (2013.01); *F15B 1/021* (2013.01)

(58) Field of Classification Search

None

See application file for complete search history.

(56) References Cited

U.S. PATENT DOCUMENTS

| | | | | |
|---|---|---|---|---|
| 3,795,280 | A * | 3/1974 | Casey | E02F 3/76 172/812 |
| 3,991,832 | A * | 11/1976 | Cooper | E02F 3/7613 172/812 |
| 4,696,367 | A | 9/1987 | Delfs | |
| 5,010,961 | A * | 4/1991 | Frisbee | E02F 3/7613 172/821 |
| 5,950,141 | A * | 9/1999 | Yamamoto | E02F 9/2292 702/41 |
| 6,035,241 | A | 3/2000 | Yamamoto | |
| 6,523,344 | B1 * | 2/2003 | Plassmeyer | F15B 11/16 60/464 |
| 8,437,926 | B2 | 5/2013 | Shintani et al. | |
| 8,700,271 | B2 * | 4/2014 | Evenson | E02F 9/2292 701/50 |
| 9,551,130 | B2 * | 1/2017 | Hendron | E02F 3/7618 |
| 9,629,299 | B2 * | 4/2017 | Swanson | E02F 3/7631 |
| 9,790,661 | B2 | 10/2017 | Hand et al. | |

(Continued)

*Primary Examiner* — Michael Leslie

(57) ABSTRACT

A dozer blade attachment control system for a work machine comprises a dozer blade attachment coupled to the attachment coupler, a hydraulic circuit, and an electronic controller. The hydraulic circuit comprises a hydraulic pump, a diverter valve operable in a first position and second position, and a pressure compensated directional control valve. The electronic controller is communicatively coupled to the hydraulic circuit. The electronic circuit may modify the hydraulic circuit to one or more of a first configuration with the diverter valve in the first position for tilt, a second configuration with the diverter valve in the second position for angling, and a third configuration with the diverter valve in the second position and the pressure compensated directional control valve creating a shuttle flow path from a higher and a lower side of the hydraulic circuit for simultaneously tilting and angling.

20 Claims, 5 Drawing Sheets

(56) References Cited

U.S. PATENT DOCUMENTS

| | | | | |
|---|---|---|---|---|
| 10,161,112 | B2 * | 12/2018 | Paull | E02F 9/245 |
| 10,533,301 | B1 * | 1/2020 | Armas | E02F 3/7609 |
| 10,907,323 | B1 * | 2/2021 | Takimoto | E02F 9/267 |
| 10,968,606 | B2 * | 4/2021 | Green | E02F 3/7613 |
| 10,995,472 | B2 * | 5/2021 | Wiewel | E02F 3/845 |

* cited by examiner

DOZER BLADE ATTACHMENT CONTROL SYSTEM AND APPARATUS FOR A COMPACT TRACK LOADER

FIELD OF THE DISCLOSURE

The present disclosure relates to a dozer blade attachment control system and apparatus for a compact track loader.

BACKGROUND

Over the years, manufacturers have continued to add versatility to the control of implements attached to various machines. For instance, compact track loaders coupled with bucket attachments originally only had control over lifting and lowering the bucket for transporting material and pitching the bucket for a digging and dumping material. With the onset of coupling compact track loaders with various other attachments, such as the dozer blade attachment, additional control over tilting and angling attachment are capabilities that have been added to compact track loaders. This change enabled an operator to control the dozer blade attachment in four degrees of freedom without exiting the operator station. However, problems arise because of inefficiencies found in the simultaneous use of all four degrees of freedom due to limitations found in the hydraulics and the mechanics on the compact track loader.

SUMMARY

This summary is provided to introduce a selection of concepts that are further described below in the detailed description and accompanying drawings. This summary is not intended to identify key or essential features of the appended claims, nor is it intended to be used as an aid in determining the scope of the appended claims.

The present disclosure includes a control system and apparatus of a dozer blade attachment on a compact track loader.

The dozer blade attachment control includes a work machine extending in a fore-aft direction having a frame and a ground-engaging mechanism wherein the ground engaging mechanism is configured to support the frame on a surface. The system further includes a boom assembly coupled to the frame wherein the boom assembly includes a pair of boom arms. An attachment coupled is coupled to a distal section of the boom arms. A dozer blade attachment may be coupled to the attachment coupler.

A hydraulic circuit may be supported on the frame. The hydraulic circuit may comprise a hydraulic pump delivering fluid through a plurality of flow paths coupled to one or more of a tilt hydraulic cylinder on the dozer blade attachment, and an angle hydraulic cylinder on the dozer blade attachment. The tilt hydraulic cylinder may be coupled to an auxiliary port supported on the frame and operationally positioned to move the dozer blade attachment in a direction of roll. The angle hydraulic cylinder may be coupled to the auxiliary port supported on the frame and operationally positioned to move the dozer blade attachment in a direction of yaw.

The hydraulic circuit may also comprise a diverter valve may be operable in a first position in delivering hydraulic fluid through a first flow path and a second position delivering hydraulic fluid through a second flow path.

The hydraulic circuit may also comprise a pressure compensated directional control valve may be operable to selectively feed from a pressure differential from the plurality of flow paths.

The system may also comprise an electronic controller communicatively coupled to the hydraulic circuit. The electronic controller may be operable to modify the hydraulic circuit one or more of a first configuration, a second configuration, and a third configuration. The first configuration places the diverter valve in the first position wherein the first position enables actuation of the tilt hydraulic cylinder. The second configuration places the diverter valve in the second position. The second position enables actuation of the angle hydraulic cylinder. The third configuration places the diverter valve in the second position enabling actuation of the angle hydraulic cylinder and the pressure compensated directional control valve creating a shuttle flow path from a higher and a lower side of the hydraulic circuit. The pressure compensated direction control valve enables simultaneous actuation of the tilt hydraulic cylinder with the hydraulic cylinder The third configuration comprises one or more of a minimum flow rate and a fixed flow rate through the second flow path for actuating the angle hydraulic cylinder The system and apparatus may further comprise a joystick with a switch coupled to the electronic controller for operating in manual mode. The joystick may be pushed to the right relative to the for-aft direction tilts the dozer blade attachment to the right and pushing the joystick to the left relative to the fore-aft direction tilts the dozer blade attachment to the left. The switch may be pushed forward to cause the dozer blade attachment to angle right and pushed rearward to cause the dozer blade attachment to angle left.

The system may further comprise a grade control system coupled to the electronic controller for operating the work machine in grade control mode. The grade control system may operate the hydraulic circuit in the third configuration. The grade control mode may enable actuation of the tilt hydraulic cylinder in automatic mode and may enable actuation of the angle hydraulic cylinder in manual mode.

The hydraulic circuit may further comprise an accumulator. The accumulator may perform one or more of storing energy, absorbing shock, building pressure gradually, and maintaining a constant pressure.

The auxiliary port on the work machine may be the single auxiliary hydraulic coupling access supported on the frame for coupling to an attachment.

The shuttle network may scavenge hydraulic fluid from the hydraulic circuit automatically to maintain the tilt hydraulic cylinder at a specific angle.

These and other features will become apparent from the following detailed description and accompanying drawings, wherein various features are shown and described by way of illustration. The present disclosure is capable of other and different configurations and its several details are capable of modification in various other respects, all without departing from the scope of the present disclosure. Accordingly, the detailed description and accompanying drawings are to be regarded as illustrative in nature and not as restrictive or limiting.

BRIEF DESCRIPTION OF THE DRAWINGS

The detailed description of the drawings refers to the accompanying figures in which.

DETAILED DESCRIPTION

The embodiments disclosed in the above drawings and the following detailed description are not intended to be exhaustive or to limit the disclosure to these embodiments. Rather, there are several variations and modifications which may be made without departing from the scope of the present disclosure.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As used herein, "based on" means "based at least in part on" and does not mean "based solely on," such that it neither excludes nor requires additional factors.

As used herein, the term "controller" is a computing device including a processor and a memory. The "controller" may be a single device or alternatively multiple devices.

Figure 1:
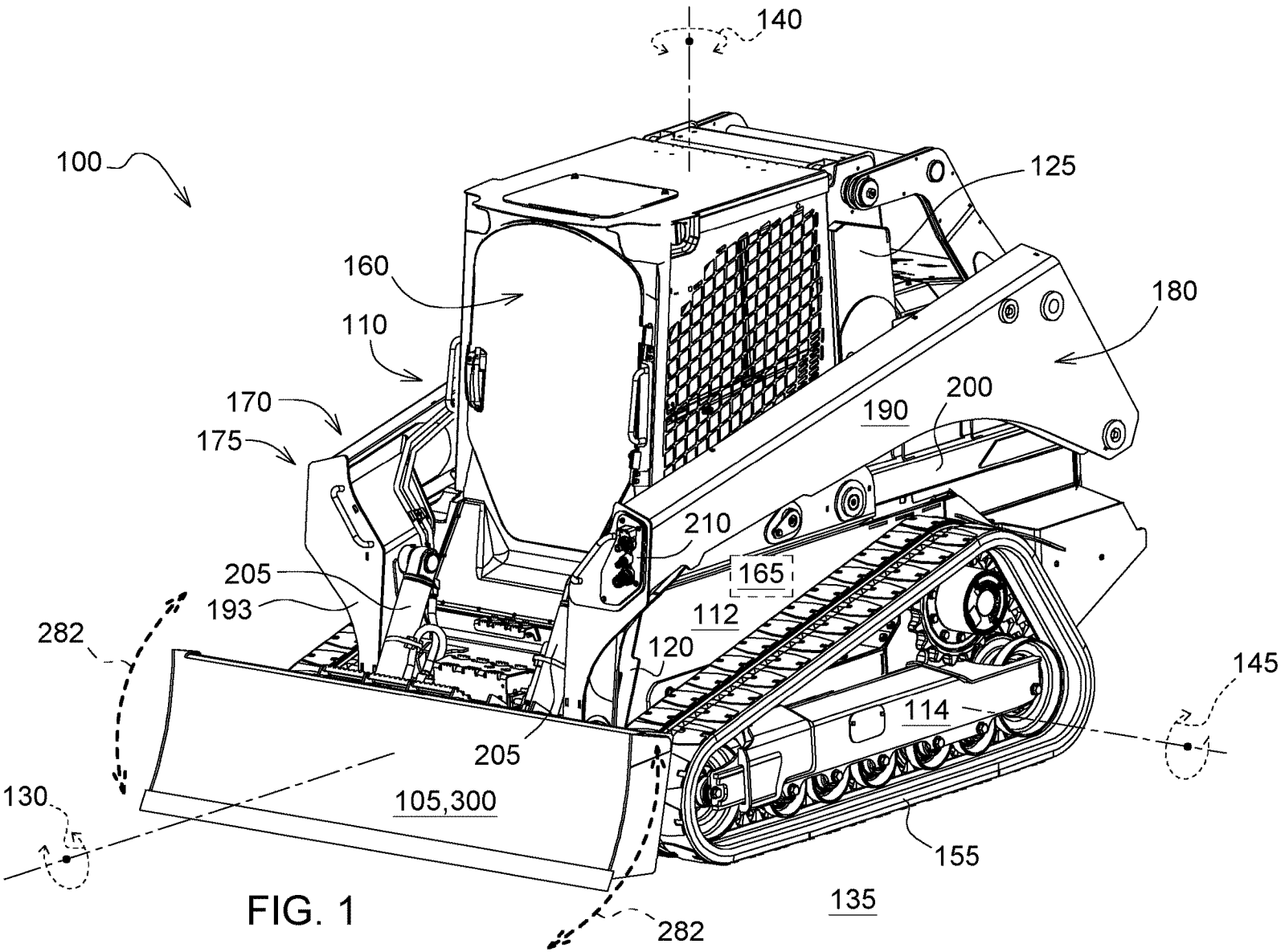
FIG. 1 is a perspective view of a compact track loader work machine according to one embodiment of the present disclosure.
Figure 2:
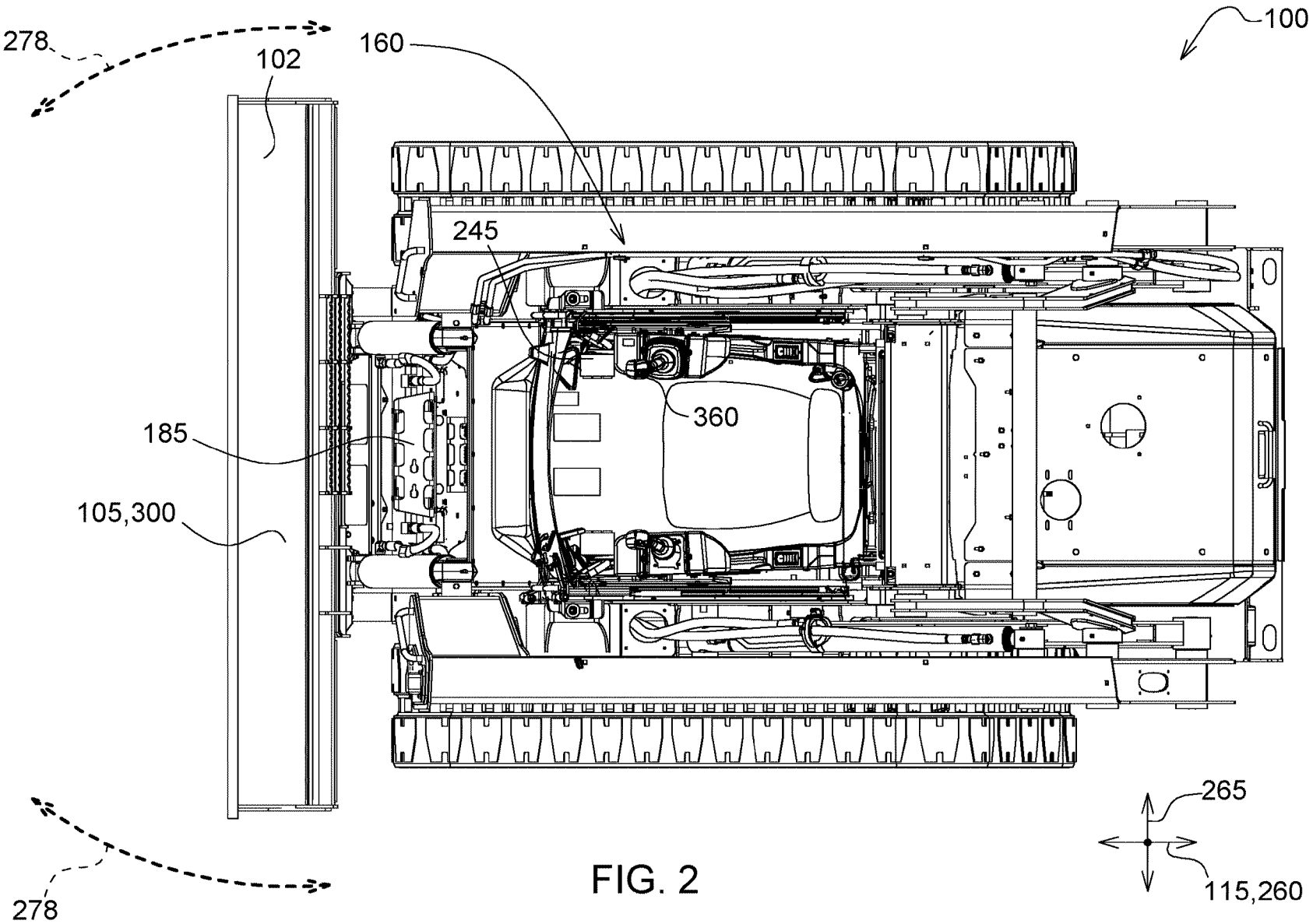
FIG. 2 is a top view of a compact track loader work machine according to one embodiment of the present disclosure.

FIGS. 1 and 2 illustrate a work machine 100, extending in a fore-aft direction 115, depicted as a compact track loader with an attachment 105 operatively coupled to the work machine 100. It should be understood, however, that the work machine 100 could be one of many types of work machines, including, and without limitation, a skid steer, a backhoe loader, a front loader, a bulldozer, and other construction vehicles with a single auxiliary port for auxiliary hydraulic coupling access. The work machine 100, as shown, has a frame 110, having a front-end section 120, or portion, and a rear-end section 125, or portion. The work machine includes a ground-engaging mechanism 155 that supports the frame 110 and an operator cab 160 supported on the frame 110, the ground-engaging mechanism 155 configured to support the frame 110 on a surface 135.

The engine 165 is coupled to the frame 110 and is operable to move the work machine 100. The illustrated work machine includes tracks, but other embodiments can include one or more wheels that engage the surface 135. Work machine 100 may be operated to engage the surface 135 and cut and move material to achieve simple or complex features on the surface. As used herein, directions with regard to work machine 100 may be referred to from the perspective of an operator seated within the operator cab 160; the left of work machine 100 is to the left of such an operator, the right of work machine is to the right of such an operator, the front or fore of work machine is the direction such an operator faces, the rear or aft of work machine is behind such an operator, the top of work machine is above such an operator, and the bottom of work machine below such an operator. In order to turn, the ground-engaging mechanism 155 on the left side of the work machine may be operated at a different speed, or in a different direction, from the ground-engaging mechanism 155 on the right side of the work machine 100. In a conventional compact track loader, the operator can manipulate controls from inside an operator cab 160 to drive the tracks on the right or left side of the work machine 100. Rotation for work machine and its various attachments may be referred to as roll 130 or the roll direction, pitch 145 or the pitch direction, and yaw 140 or the yaw direction. These defined directions will be further referenced below when discussing movement of the dozer blade attachment 300.

The work machine 100 comprises a boom assembly 170 coupled to the frame 110. An attachment 105, or work tool, may be pivotally coupled at a forward portion 175 of the boom assembly 170, while a rear portion 180 of the boom assembly 170 is pivotally coupled to the frame 110. The frame 110 comprises a mainframe 112 and a track frame 114 (in other work machines the track frame may alternatively be referred to as a frame for a ground-engaging mechanism). The attachment 105 is illustrated as a dozer blade attachment 300 but may be any number of work tools such as a bucket, forks, an auger, a drill, or a hammer, just to name a few possibilities. The dozer blade attachment 300 is an attachment which may engage the ground or material to move or shape it. Dozer blade attachment may be used to move material from one location to another and to create features on the ground, including flat area, grades, hills, roads, or more complexly shaped features. The dozer blade attachment in the present embodiment, as applied to a compact track loader, may be referred to as a six-way blade as shown in the embodiment herein, six-way adjustable blade, or pitch-angle-tilt (PAT) blade.

The attachment 105 may be coupled to the boom assembly 170 through an attachment coupler 185, such as Deere and Company's Quik-Tatch, which is an industry standard configuration and a coupler universally applicable to many Deere attachments and several after-market attachments. The attachment coupler 185 may be coupled to a distal section of the boom arms 193, or more specifically a portion of the boom arms in the forward portion 175 of the boom assembly 170.

The boom assembly 170 comprises a first pair of boom arms 190 pivotally coupled to the frame 110 (one each on a left side and a right side of the operator cab 160) and moveable relative to the frame 110 by a pair of first hydraulic cylinders 200, wherein the pair of first hydraulic cylinders 200 may also conventionally be referred to as a pair of lift cylinders (one coupled to each boom arm) for a compact track loader. The attachment coupler 185 coupled to a forward section 193, or portion, of the pair of boom arms 190, may be moveable relative to the frame 110 by a pair of second hydraulic cylinders 205, conventionally referred to as pitch cylinders for a compact track loader. Now referring to FIG. 3 with continued reference to FIGS. 1 and 2, the frame 110 of the work machine 100 further comprises an auxiliary port 210 on the front-end portion 120 of the work machine 100 to couple one or more auxiliary hydraulic cylinders 215 (i.e. hydraulic cylinders found on attachment 105) to drive movement of or actuate auxiliary functions of an attachment 105. The attachment coupler 185 enables the mechanical coupling of the attachment to the frame 110. The auxiliary port 210, contrary to the attachment coupler 185, enables the hydraulic coupling of auxiliary hydraulic cylinder(s) 215 on the attachment 105 to the hydraulic circuit 220. The auxiliary hydraulic cylinders 215 on a dozer blade attachment 300 include a single tilt hydraulic cylinder 305 and a pair of angling hydraulic cylinders 310. The tilt hydraulic cylinder 305 tilts blade relative to the work machine 100, which may also be referred to as moving the dozer blade attachment 300 in the direction of roll 130. That is, actuating the auxiliary hydraulic cylinder(s) 215 (more specifically the tilt hydraulic cylinder 305) actuates the dozer blade attachment 300 tilts blade in a radial motion about the forward portion 175 of the boom assembly 170 (shown by dotted line 282). The pair of angling hydraulic cylinders 310 allows for the dozer blade attachment 320 to move in the direction of yaw 140, or angle the dozer blade attachment 300 relative to the work machine 100 in the direction of yaw 140 (shown as dotted line 278).

Each of the pair of first hydraulic cylinders 200, the pair of second hydraulic cylinders 205, and the auxiliary cylinders 215 are double acting hydraulic cylinders. One end of each cylinder may be referred to as a head end, and the end of each cylinder opposite the head end may be referred to as a rod end. Each of the head end and the rod end may be fixedly coupled to another component, such as a pin-bushing or pin-bearing coupling, to name but two examples of pivotal connections. As a double acting hydraulic cylinder, each may exert a force in the extending or retracting direction. Directing pressurized hydraulic fluid 235 into a head chamber of the cylinders will tend to exert a force in the extending direction, while directing pressurized hydraulic fluid into a rod chamber of the cylinders will tend to exert a force in the retracting direction. The head chamber and the rod chamber may both be located within a barrel of the hydraulic cylinder and may both be part of a larger cavity which is separated by a moveable piston connected to a rod of the hydraulic cylinder. The volumes of each of the head chamber and the rod chamber change with movement of the piston, while movement of the piston results in extension or retraction of the hydraulic cylinder.

Figure 3:
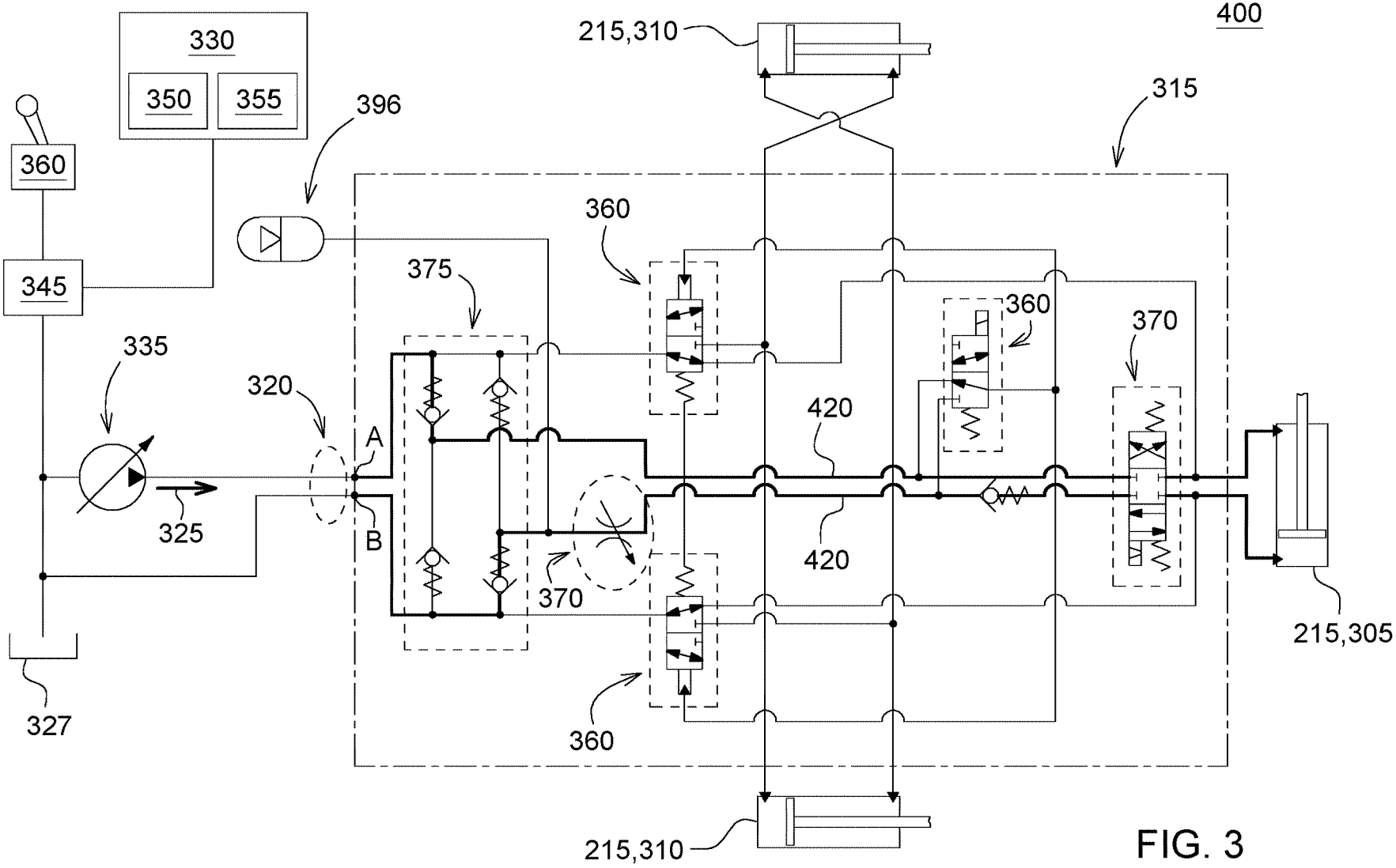
FIG. 3 is a schematic of the dozer blade attachment control system and other parts of the compact track loader work machine of FIG. 1, according to one embodiment of the present disclosure.

As shown in FIGS. 1 and 3 and per industry standard, the compact track loader generally supports a single auxiliary port 210 wherein the auxiliary port comprises an A and B port 320 for a flow and return line to a reservoir 327 of hydraulic fluid 325 (shown by arrow) located on the compact track loader for the hydraulic circuit 315. Please note that in alternative attachments may not have one or more auxiliary hydraulic cylinders and therefore may not use the auxiliary port 210. This is unlike the configuration of the present embodiment, wherein a dozer blade attachment 300 is coupled to a compact track loader.

The dozer blade attachment 300 uses the auxiliary port 210 and has auxiliary hydraulic cylinders 215, as described in further detail below.

Because of the single auxiliary port 210 (meaning the A and B out and return line) this standard configuration generally allows for coupling actuating a single set of actuators for movement of the attachment 105 in one direction at any given moment (e.g. actuating the tilt hydraulic cylinders 305 or the angling hydraulic cylinders 310), or alternatively resulting in poor fuel efficiency because of a chronic parasitic load on the system. That is, there currently exists two standard configurations of hydraulic circuits when coupling a dozer blade attachment 300 to a compact track loader through the auxiliary port 210. The first standard configuration uses a diverter valve method. The diverter valve method toggles between control of the tilt hydraulic cylinder 305 and the angling hydraulic cylinders 310. This first standard configuration is efficient wherein only the flow of hydraulic fluid 325 required to run the respective hydraulic cylinder (i.e. tilt or angle, but not both simultaneously) is driven out to the boom dozer blade attachment 300 as needed. In a second standard configuration, the hydraulic circuit uses a sectional valve. The sectional valve method flows hydraulic fluid to the dozer blade attachment continuously and is split between the tilt hydraulic cylinder 305 and the angling hydraulic cylinders 310, as needed. Although this approach enables simultaneous control of moving the dozer blade attachment in a tilt direction (direction of roll 130) and an angling direction (direction of yaw 140), this approach disadvantageously creates a constant parasitic load on the engine 165 resulting in poor fuel efficiency.

Furthermore, simultaneously control of both tilt hydraulic cylinder 305 and angle hydraulic cylinders 310 is generally required for advanced control uses such as grade control applications wherein the operator is angling the dozer blade attachment 300 in a controlled position relative to the ground 135 and wants the grade control system 330 to maintain the dozer blade attachment 300 on the grade designated.

One known grade control system 330 is available from Deere & Company of Moline, Ill., as an Integrated Grade Control (IGC) system, which generally is a blade control system using the combination of sensor input (e.g., GPS) and stored data (e.g., maps). The IGC system may also allow for operator control of an initial position setting, such as an initial height of a dozer blade attachment. The IGC system may also allow for a combination of operator and automated position control. For example, the angle of the dozer blade attachment 300 may be initially or continuously under the control of the operator via a suitable control interface (e.g., joystick controls), and the tilt (e.g., the heel end) of the dozer blade attachment may be controlled automatically according to input from a sensor 350 and data storage 355.

The dozer blade attachment control system 400 described below, comprising the auxiliary hydraulic cylinders 215 as coupled to the work machine through the auxiliary port 210 with the hydraulic circuit 315 advantageously addresses the above inefficiencies.

FIG. 3 is a schematic of a portion of the dozer blade attachment control system 400 for controlling the auxiliary hydraulic cylinders 215 as it relates to the components of the work machine 100 in the embodiments disclosed herein with an emphasis on the portion of the hydraulic circuit 315 related to the dozer blade attachment 300, the hydraulic circuit 315 supported on the frame 110 of the work machine 100. Each of the auxiliary hydraulic cylinders 215, that is the tilt auxiliary hydraulic cylinder 305 and the angling hydraulic cylinders 310, may be positioned on a portion of or be a part of the dozer blade attachment 300. The hydraulic circuit 315 receives pressurized hydraulic fluid 325 (designated by an arrow) from hydraulic pump 335, which generally may be coupled to the engine 165 or an alternative power source, and directs such hydraulic fluid 325 to one or more of the tilt auxiliary hydraulic cylinder 305 and the angling hydraulic cylinders 310. A hydraulic control valve (not shown) may meter such fluid out or control the flow rate of hydraulic fluid 325 through the hydraulic circuit 315 to which it is connected. Alternatively, hydraulic control valve may not meter such fluid out but may instead only selectively provide flow to these functions while metering is performed by another component (e.g. a variable displacement hydraulic pump). A hydraulic control valve may meter such fluid out through a plurality of flow paths or spools, whose positions control the flow of hydraulic fluid, and other hydraulic logic. The spools may be actuated by solenoids, pilots (e.g. pressurized hydraulic fluid acting on the spool), the pressure upstream or downstream of the spool, or some combination of these or other uses. The electronic controller 345 of the work machine 100 actuates these solenoids by sending a specific current to each (e.g. 600 mA). In this way, the electronic controller 345 may actuate an attachment 105 by issuing electrical command signals to direct hydraulic fluid 235 flow from the hydraulic pump 230 through a plurality of flow paths.

Electronic controller 345, which may also be referred to as a vehicle control unit (VCU), is in communication with a number of components on the work machine 100, including the hydraulic circuit 315, electrical components such as operator inputs from within the operator cab 160, and other components. The electronic controller 345 is electrically coupled to these other components wirelessly or by a wiring harness such that messages, commands, and electrical power may be transmitted between electronic controller 345 and the remainder of the work machine 100. The electronic controller 345 may be coupled to other electronic controllers, such as the engine control unit (ECU), through a controller area network (CAN), or a sub-controller (if applicable) of an attachment wherein the sub-controller interprets command signals from the electronic controller 345 to control movement of auxiliary hydraulic cylinders 215 located on an attachment 105. The electronic controller 345 may then send and receive messages over the CAN to communicate with other components of the CAN. The electronic controller 345 may send command signals to actuate the dozer blade attachment 300 by sending a command signal to actuate an input from the user input interface 245 from the operator cab 160 or alternatively input from a sensor 350 (e.g. a sensor used in grade control) and data storage 355 comprising grade maps or lands. For example, an operator may use a joystick 360 with a switch to issue command to actuate an attachment 105, and the joystick 360 with a switch may generate hydraulic pressure signals communicated to various valves within the hydraulic circuit 315 to cause actuation of the dozer blade attachment 300. In such a configuration, the electronic controller 345 may be in communication with electrical devices (solenoids, motors) which may be actuated by a joystick 250 in operator cab 160. Other alternative inputs on a user input interface 245 (shown in FIG. 2) aside from a joystick with electric, or hydraulic pressure signals may include touchscreens, foot pedals, virtual operative signaling, to name a few. Forms of a switch may include buttons, roller tabs, sliding tabs, infinity switches, etc.

The schematic of the dozer blade control system 400 with a portion of the hydraulic circuit 315 shown in FIG. 3 discloses the addition of a diverter valve 360 operable in a first position and a second position; and a pressure compensated directional control valve 370 operable to selectively feed from a pressure differential from the plurality of flow paths. The diverter valve 360, in the present embodiment, and as shown in FIG. 3 comprises three individual two position three-way valves.

Figure 4:
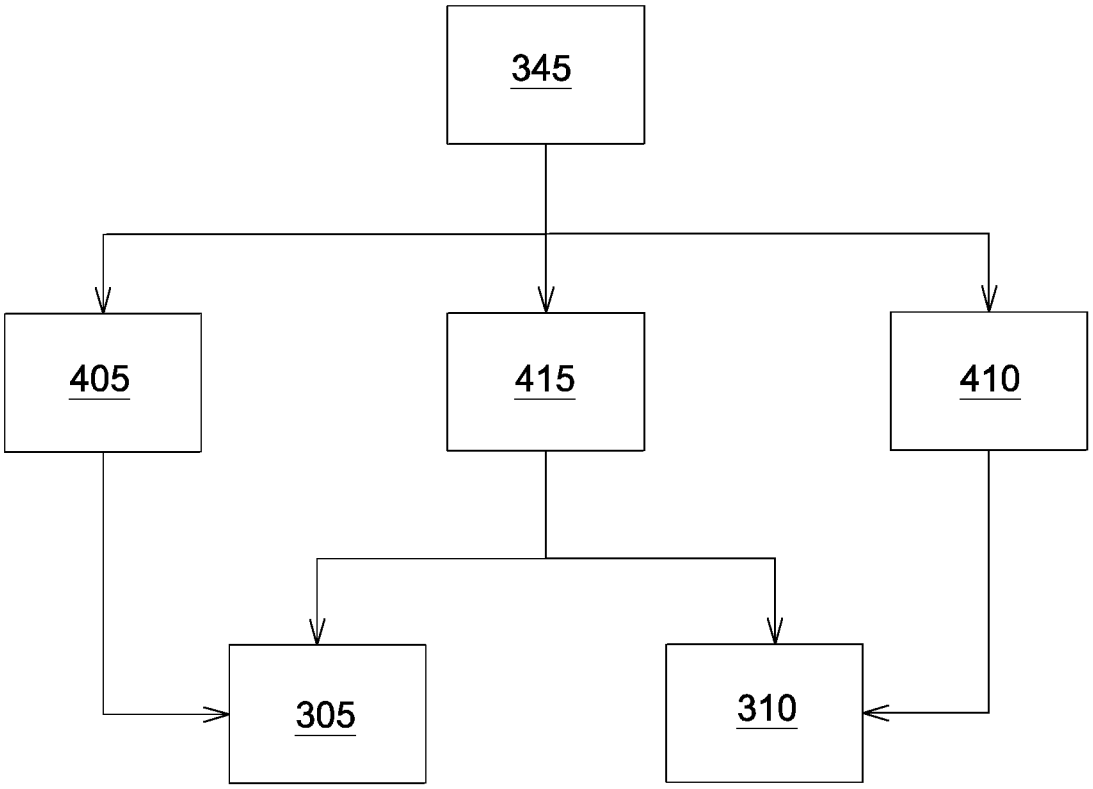
FIG. 4 is a high-level schematic of the hydraulic cylinders moved from fluid flow directed through various configurations as determined the electronic controller.

Now turning to FIG. 4 with continued reference to FIG. 3, the electronic controller 345, communicatively coupled to the hydraulic circuit 315, may modify the flow of the hydraulic fluid 325 through the hydraulic circuit 315 to one or more of a first configuration 405, a second configuration 410, and a third configuration 415. As seen in FIG. 3, the first configuration 405 places the diverter valve 360 in a first position wherein the first position enables actuation of the tilt hydraulic cylinder 305. The first configuration 405 is a default configuration for the respective pressurized hydraulic circuit 315 and enables control of the tilt function. The default configuration meaning the diverter valves remain in a de-energized state.

The second configuration 410 places the diverter valve 360 in a second position wherein the second position enables actuation of the angle hydraulic cylinder 310. Activating the diverter valve 360, places the diverter valve in the second position, in an energized state, creating a pressurized hydraulic circuit 315 for enabling control of the angle function.

The third configuration 415 places the diverter valve 360 in the second position enabling actuation of the angle hydraulic cylinders 310; while simultaneously setting the pressure compensated directional control valve 370 to a minimum threshold thereby enabling simultaneous actuation of the tilt hydraulic cylinder 305 alongside the angle hydraulic cylinders 310. Activating the pressure compensated directional control valve 370 creates a shuttle flow path 420 (shown by the bold lines in FIG. 3) from a higher side and a lower side of the hydraulic circuit 315, connecting them to create a pressure compensated circuit with a minimum flowrate, the minimum flowrate creating sufficient supplemental pressurization in the hydraulic circuit 315 for actuating the tilt hydraulic cylinder 305. A series of check valves in parallel create a check valve network 375 are used to determine the high and low side pressure from the A and B port 320 to draw from for the supplemental pressurization powering the tilt hydraulic cylinder 305.

The third configuration 415 of the hydraulic circuit may only become functional when the hydraulic circuit comprises one or more of minimum flow rate and a fixed flow rate for actuation of the angle hydraulic cylinders 310. That is, a minimum flow rate ensures a sufficient pressure within the hydraulic circuit 315 for the shuttle flow path 420 to siphon power for movement of the tilt hydraulic cylinder 305. Unlike default designs discussed above, the third configuration 415 advantageously enables simultaneously control of both the angling hydraulic cylinders 310 and the tilt hydraulic cylinder 305 without creating a parasitic load.

Figure 5:
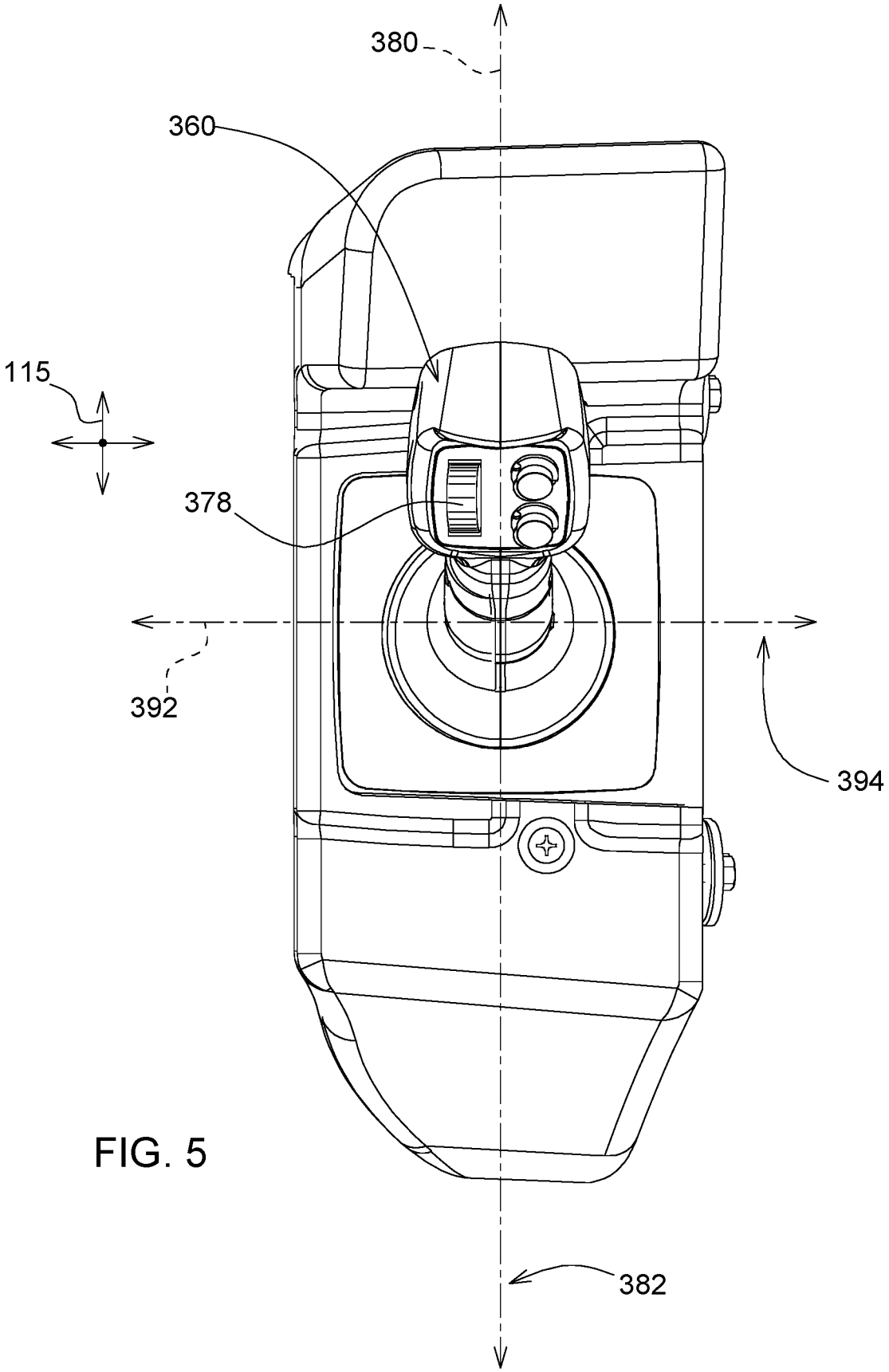
FIG. 5 is a perspective view of a portion of the user input interface.

Now referring to FIG. 5 with continued reference to FIG. 3, the dozer blade attachment control system 400 may further comprise a joystick 360 with a switch 378 coupled to the electronic controller 345 for operating in manual mode or a semi-automatic mode. Pushing the joystick to the right relative to the fore-after direction 115, and relative to the view of the operator, may tilt the dozer blade attachment 300 to the right. Pushing the joystick 360 to the left relative to the fore-aft direction 115, and relative to the view of the operator, may tilt the dozer blade attachment 300 to the left. Furthermore, rolling the switch forward 380 may cause the dozer blade attachment 300 to angle right, and rolling the switch rearward 382 may cause the dozer blade attachment 300 to angle left.

The dozer blade attachment control system 400 may further comprise a grade control system 330 coupled to the electronic controller 345 for operating the work machine 100 in grade control mode, the grade control mode being at least partially automated. The grade control system 330 only operates when the hydraulic circuit 315 is in the third configuration discussed above. In one embodiment, the grade control mode may actuate the tilt hydraulic cylinder 305 in automatic mode and the angle hydraulic cylinders 310 in manual mode. In an alternative configuration, grade control mode may actuate the tilt hydraulic cylinder 305 and the angle hydraulic cylinders 310 in automatic mode. In both instances, the shuttle network 420 scavenges hydraulic fluid 425 from the hydraulic circuit 315 automatically to maintain the tilt hydraulic cylinder 305 at a specific tilt angle. The electronic controller 345 may adjust the position the dozer blade attachment 300 in all four respective positions (pitch, angle, tilt, and blade height) based on sensor 350 input and stored data 355 input wherein the pitch and blade height are controlled by the pair of first hydraulic cylinders 200 and pair of second hydraulic cylinders 205 on the work machine 100.

Now referring only to FIG. 3, the hydraulic circuit 315 may further comprise an accumulator 396. The accumulator 396 may perform one of more of storing energy, absorbing shock, building pressure gradually, or maintaining a constant pressure. Similar to a spring, the simplest accumulator, where when compressed the spring becomes a source of potential energy, an accumulator functions the same way. It can also be used to absorb shocks or to control the force on a load. Accumulators in hydraulic circuits work in much the same way, function basically as containers which store hydraulic fluid 325 under pressure. The accumulator 396 may include but are not limited to pneumatic accumulators, weight-loaded accumulators, and spring-loaded accumulators.

Accumulators which store energy are often used as "boosters" for systems with fixed displacement pumps. The accumulator stores pressure oil during slack periods and feeds it back into the system during peak periods of oil usage. The pump recharges the accumulator after each peak. Accumulators which absorb shocks take in excess hydraulic fluid during peak pressures and let it out again after the "surge" is past. This reduces vibrations and noise in the system. The accumulator may also smooth out operation during pressure delays, as when a variable displacement pump goes into stroke. By discharging at this moment, the accumulator "takes up the slack." Accumulators which build pressure gradually are used to "soften" the working stroke of a piston against a fixed load. By absorbing some of the rising hydraulic fluid pressure the accumulator slows down the stroke. Accumulators which maintain constant pressure are always weight-loaded types which place a fixed force on the hydraulic fluid in a closed circuit. Whether the volume of hydraulic fluid changes from leakage or from heat expansion or contraction, this accumulator keeps the same gravity pressure on the system. Incorporation of the accumulator 396 in hydraulic circuit 315 advantageously allows for a smooth transition when engaging the shuttle path 420 with the third configuration 415.

While the above describes example embodiments of the present disclosure, these descriptions should not be viewed in a restrictive or limiting sense. Rather, there are several variations and modifications which may be made without departing from the scope of the appended claims.

What is claimed is:

1. A dozer blade attachment control system for a work machine, the work machine extending in a fore-aft direction, the system comprising:

a frame and a ground-engaging mechanism, the ground-engaging mechanism configured to support the frame on a surface;

a boom assembly coupled to the frame, the boom assembly having a pair of boom arms;

an attachment coupler coupled to a distal section of the boom arms;

a dozer blade attachment coupled to the attachment coupler;

a hydraulic circuit supported on the frame, the hydraulic circuit comprising a hydraulic pump delivering fluid through a plurality of flow paths coupled to one or more of a tilt hydraulic cylinder on the dozer blade attachment and an angle hydraulic cylinder on the dozer blade attachment, the tilt hydraulic cylinder coupled to an auxiliary port supported on the frame and operationally positioned to move the dozer blade attachment in a direction of roll, the angle hydraulic cylinder coupled to the auxiliary port supported on the frame, and operationally positioned to move the dozer blade attachment in a direction of yaw;

a diverter valve operable in a first position delivering hydraulic fluid through a first flow path and a second position delivering hydraulic fluid through a second flow path;

a pressure compensated directional control valve operable to selectively feed from a pressure differential from the plurality of flow paths; and an electronic controller communicatively coupled to the hydraulic circuit, the electronic controller operable to modify the hydraulic circuit to one or more of a first configuration with the diverter valve in the first position, the first position enabling actuation of the tilt hydraulic cylinder, a second configuration with the diverter valve in the second position, the second position enabling actuation of the angle hydraulic cylinder; and a third configuration with the diverter valve in the second position enabling actuation of the angle hydraulic cylinder and the pressure compensated directional control valve creating a shuttle flow path from a higher and a lower pressure side of the hydraulic circuit, the pressure compensated directional control valve enabling simultaneous actuation of the tilt hydraulic cylinder.

2. The dozer blade attachment control system of claim 1, wherein the third configuration comprises one or more of a minimum flow rate and a fixed flow rate through the second flow path for actuation of the angle hydraulic cylinder.

3. The dozer blade attachment control system of claim 1, the system further comprising:

a joystick with a switch coupled to the electronic controller for operating in manual mode, wherein pushing the joystick to the right relative to the for-aft direction tilts the dozer blade attachment to the right and pushing the joystick to the left relative to the fore-aft direction tilts the dozer blade attachment to the left, and pushing the switch forward causes the dozer blade attachment to angle right and pushing the switch rearward causes the dozer blade attachment to angle left.

4. The dozer blade attachment control system of claim 1, the system further comprising:

a grade control system coupled to the electronic controller for operating the work machine in grade control mode, the grade control system operating the hydraulic circuit in the third configuration.

5. The dozer blade attachment control system of claim 4, wherein the grade control mode enables actuation of the tilt hydraulic cylinder in automatic mode and enables actuation of the angle hydraulic cylinder in manual mode.

6. The work machine of claim 4, wherein the grade control mode enables actuation of the tilt hydraulic cylinder in automatic mode and enables actuation of the angle hydraulic cylinder in automatic mode.

7. The dozer blade attachment control system of claim 1, wherein the hydraulic circuit further comprises an accumulator.

8. The dozer blade attachment control system of claim 7, wherein the accumulator performs one or more of storing energy, absorbing shock, building pressure, and maintaining a constant pressure.

9. The dozer blade attachment control system of claim 1, wherein the auxiliary port is a single auxiliary hydraulic coupling access supported on the frame for coupling to an attachment.

10. The dozer blade attachment control system of claim 1, wherein the shuttle network scavenges hydraulic fluid from the hydraulic circuit automatically to maintain the tilt hydraulic cylinder at a specific tilt angle.

11. A work machine comprising a dozer blade attachment, the work machine comprising:

a frame and a ground-engaging mechanism, the ground-engaging mechanism configured to support the frame on a surface;

a boom assembly coupled to the frame, the boom assembly having a pair of boom arms;

an attachment coupler coupled to a distal section of the boom arms;

a dozer blade attachment coupled to the attachment coupler;

a hydraulic circuit supported on the frame, the hydraulic circuit comprising a hydraulic pump delivering fluid through a plurality of flow paths coupled to one or more of a tilt hydraulic cylinder on the dozer blade attachment and an angle hydraulic cylinder on the dozer blade attachment, the tilt hydraulic cylinder coupled to an auxiliary port supported on the frame and operationally positioned to move the dozer blade attachment in a direction of roll, the angle hydraulic cylinder coupled to the auxiliary port supported on the frame, and operationally positioned to move the dozer blade attachment in a direction of yaw;

a diverter valve operable in a first position delivering hydraulic fluid through a first flow path and a second position delivering hydraulic fluid through a second flow path;

a pressure compensated directional control valve operable to selectively feed from a pressure differential from the plurality of flow paths; and an electronic controller communicatively coupled to the hydraulic circuit, the electronic controller operable to modify the hydraulic circuit to one or more of a first configuration with the diverter valve in the first position, the first position enabling actuation of the tilt hydraulic cylinder, a second configuration with the diverter valve in the second position, the second position enabling actuation of the angle hydraulic cylinder; and a third configuration with the diverter valve in the second position enabling actuation of the angle hydraulic cylinder and the pressure compensated directional control valve creating a shuttle flow path from a higher and a lower pressure side of the hydraulic circuit, the pressure compensated directional control valve enabling simultaneous actuation of the tilt hydraulic cylinder.

12. The work machine of claim 11, wherein the third configuration comprises one or more of a minimum flow rate and a fixed flow rate through the second flow path for actuation of the angle hydraulic cylinder.

13. The work machine of claim 11 further comprising:

a joystick with a switch coupled to the electronic controller for operating in manual mode, wherein pushing the joystick to the right relative to a for-aft direction tilts the dozer blade attachment to the right and pushing the joystick to the left relative to the fore-aft direction tilts the dozer blade attachment to the left, and pushing the switch forward causes the dozer blade attachment to angle right and pushing the switch rearward causes the dozer blade attachment to angle left.

14. The work machine of claim 11 further comprising:

a grade control system coupled to the electronic controller for operating the work machine in grade control mode, the grade control system operating the hydraulic circuit in the third configuration.

15. The work machine of claim 14, wherein the grade control mode enables actuation of the tilt hydraulic cylinder in automatic mode and enables actuation of the angle hydraulic cylinder in manual mode.

16. The work machine of claim 14, wherein the grade control mode enables actuation of the tilt hydraulic cylinder in automatic mode and enables actuation of the angle hydraulic cylinder in automatic mode.

17. The work machine of 11, wherein the hydraulic circuit further comprises an accumulator.

18. The work machine of claim 16, wherein the accumulator performs one or more of storing energy, absorbing shock, building pressure, and maintaining a constant pressure.

19. The work machine of claim 11, wherein the auxiliary port is a single auxiliary hydraulic coupling access supported on the frame for coupling to an attachment.

20. The work machine of claim 11, wherein the shuttle network scavenges hydraulic fluid from the hydraulic circuit automatically to maintain the tilt hydraulic cylinder at a specific tilt angle.

* * * * *